US005716129A

United States Patent [19]

Kunen et al.

[11] Patent Number: 5,716,129

[45] Date of Patent: Feb. 10, 1998

[54] PROXIMITY SWITCH FOR LIGHTING DEVICES

[75] Inventors: Scott M. Kunen, Akron, Ohio; Gilbert Atencio, Anaheim, Calif.

[73] Assignee: Right Touch, Inc., Fountain Valley, Calif.

[21] Appl. No.: 509,347

[22] Filed: Jul. 31, 1995

[51] Int. Cl.[6] ..... F21V 23/04

[52] U.S. Cl. ..... 362/394; 307/116; 361/179

[58] Field of Search ..... 307/116; 323/904; 362/276, 395, 802, 394; 361/179, 181

[56] References Cited

U.S. PATENT DOCUMENTS

| | | | |
|---|---|---|---|
| 4,119,864 | 10/1978 | Petrizio | 307/116 |
| 4,152,629 | 5/1979 | Raupp | 315/362 |
| 4,213,061 | 7/1980 | Conner | 307/116 |
| 4,237,386 | 12/1980 | Instance | 307/116 |
| 4,246,494 | 1/1981 | Foreman et al. | 307/116 |
| 4,246,533 | 1/1981 | Chiang | 323/349 |
| 4,250,432 | 2/1981 | Kohler | 315/291 |
| 4,264,831 | 4/1981 | Wern | 307/252 H |
| 4,293,745 | 10/1981 | Matsuda et al. | 200/52 R |
| 4,321,479 | 3/1982 | Ledniczki et al. | 307/116 |
| 4,360,737 | 11/1982 | Leopold | 307/116 |
| 4,468,573 | 8/1984 | Hehl | 307/113 |
| 4,490,625 | 12/1984 | Dilly | 307/116 |
| 4,558,261 | 12/1985 | Cheng | 315/209 R |
| 4,668,876 | 5/1987 | Skarman | 307/116 |
| 4,672,229 | 6/1987 | Skarman et al. | 307/115 |
| 4,723,080 | 2/1988 | Cline et al. | 307/116 |
| 5,010,460 | 4/1991 | Lin | 362/101 |

OTHER PUBLICATIONS

LSI Computer Systems, Inc. LS7237, "Tough Sensitive Light Dimmer/Switch", Nov. 1983, pp. 1–4.

LSI Computer Systems, Inc. S7231–LS7235, "Touch Sensitive Light Dimmer/Switch", Dec. 1983, pp. 1–6.

"Electronic Light Dimmer, Electronic Light Switch", S567 A,B,C; S576 D, pp. 1–10, Siemans Corporation, Mar. 1982.

*Primary Examiner*—Stephen F. Husar

*Attorney, Agent, or Firm*—Knobbe, Martens, Olson & Bear LLP

[57] ABSTRACT

A proximity switch for controlling lighting devices includes an oscillator operating at a nominal frequency. When a hand is positioned near a sensing antenna, the frequency of the oscillator decreases. The decrease in frequency is detected by a detection circuit which toggles a flip-flop. The output of the flip-flop controls a trigger circuit which provides a trigger input to a triac. When the trigger circuit is active, the triac conducts and provides power to an incandescent lamp. The power is alternatively toggled on and off each time the hand is brought into proximity to the sensing antenna.

4 Claims, 3 Drawing Sheets

PROXIMITY SWITCH FOR LIGHTING DEVICES

BACKGROUND OF THE INVENTION

1. Field of the Invention

The present invention is in the field of lighting controls, and, in particular, is in the field of non-mechanical, electronic lighting controls.

2. Description of the Related Art

Lamps and other electrically powered lighting devices are conventionally controlled by mechanical switches having contacts which open or close an electrical circuit providing power to the lighting device in response to manual activation. In many applications, mechanical switches are not desirable. Thus, touch control switches have been developed which do not require mechanical contacts, or the like, and which respond to the mere touch of a person's hand, for example, rather than requiring movement of a switch activator. There are a number of advantages to a touch controlled switch. For example, touch control switches operate silently; they do not require the exertion of force; they can be easily operated by one finger; they are more aesthetically pleasing; and there are no mechanical parts to wear out.

Touch control switches, however, have the disadvantage that a metallic touch plate or other electrically conductive portion is required to enable the user to activate the switch. For example, U.S. Pat. No. 4,672,229 illustrates a rectangular touch plate on the front of a wall switch. U.S. Pat. No. 4,668,876 requires that a portion (e.g., the base) of a lamp be electrically conductive. U.S. Pat. No. 4,152,629 to Raupp utilizes the conductivity of a living plant as part of the touch control circuit. U.S. Pat. No. 4,558,261 to Cheng discloses a touch control circuit which operates with non-metallic lamps by using an induction-type brightness adjusting switch. An induction plate generates a magnetic field which is changed when the user's hand touches the lamp and causes the circuit to respond.

There continues to be a need for a non-mechanical circuit which does not require the user to touch the lamp or any other activation device in order to cause the circuit to control the electrical power to a lamp or other lighting device. Such a circuit would be particularly useful in connection with decorative table lamps, other lamps, decorative lighting, or the like, because the user would no longer have to touch the device, thus reducing the maintenance on the device. Furthermore, the outside of the device would not have to be modified to provide a metallic surface or other contact portion.

SUMMARY OF THE INVENTION

One aspect of the present invention is a power control system for a lighting device. The power control system comprises a variable frequency oscillator which generates an output signal having an oscillation frequency responsive to a capacitance. A sensing antenna is coupled to the oscillator such that when a hand or other mass is moved proximate to the sensing antenna, the capacitance increases to vary the oscillation frequency. The sensing antenna comprises an electrically conductive material positioned within an electrically insulating enclosure such that contact by the hand or other mass with the sensing antenna is precluded. A detection circuit is coupled to receive a signal responsive to the oscillation frequency. The detection circuit generates a detection output signal. The detection circuit activates the detection output signal when the oscillation frequency decreases. A power control circuit receives power from a power source and selectively applies the power to the lighting device. The power control circuit is responsive to the detection output signal to vary power applied to the lighting device each time the detection output signal is activated by the detection circuit. For example, the electrically insulating enclosure may comprise the body of a lamp, and the lighting device may comprise a socket-mounted lighting fixture supported by the lamp. Alternatively, the electrically insulating enclosure comprises an ornament having a power input cord and a power output. The power control circuit controls the power applied to the power output. In certain preferred embodiments, the detection circuit comprises a one-shot multivibrator which generates a measuring pulse for each cycle of the signal responsive to the oscillation frequency. The detection circuit generates the detection output signal in response to a detected difference between a duration of the measuring pulse and a duration of a half-cycle of the signal responsive to the oscillation frequency.

Another aspect of the present invention is a lamp having a power control switch which operates in response to a positioning of a person's hand proximate to the lamp without touching the lamp. The lamp comprises a hollow body supported by a base. The hollow body comprises an electrically insulating material. A socket is supported by the body. The socket is configured to receive a socket-mounted lighting device. A power cord has a first end connectable to a source of power and has a second end within the hollow body. A sensing antenna is positioned within the hollow body and is electrically insulated by the hollow body. A power control circuit has a power input electrically connected to the second end of the power cord. The power control circuit has a power output electrically connected to the socket. The power control circuit is electrically connected to the sensing antenna and is responsive to changes in capacitance sensed by the sensing antenna to control power applied to the socket.

Another aspect of the present invention is a control device for ornamental lights. The control device comprises a hollow ornament having a shell comprising an electrically insulating material. The shell of the hollow ornament has at least one opening. A power input cord is positioned through the opening. The power input cord has a first end outside the shell and is connectable to a source of power. The power cord has a second end within the shell. A power output is positioned through the opening. The power output has a first end within the shell. The power output has a second end outside the shell and is connectable to provide power to the ornamental lights. A sensing antenna is positioned within the shell and is electrically insulated by the shell. A power control circuit has a power input electrically connected to the second end of the power cord. The power control circuit has a power output electrically connected to the first end of the power output. The power control circuit is electrically connected to the sensing antenna and is responsive to changes in capacitance sensed by the sensing antenna to control power applied to the power output.

BRIEF DESCRIPTION OF THE DRAWINGS

The present invention will be described below in connection with the accompanying drawing figures in which.

DETAILED DESCRIPTION OF THE PREFERRED EMBODIMENT

Figure 1:
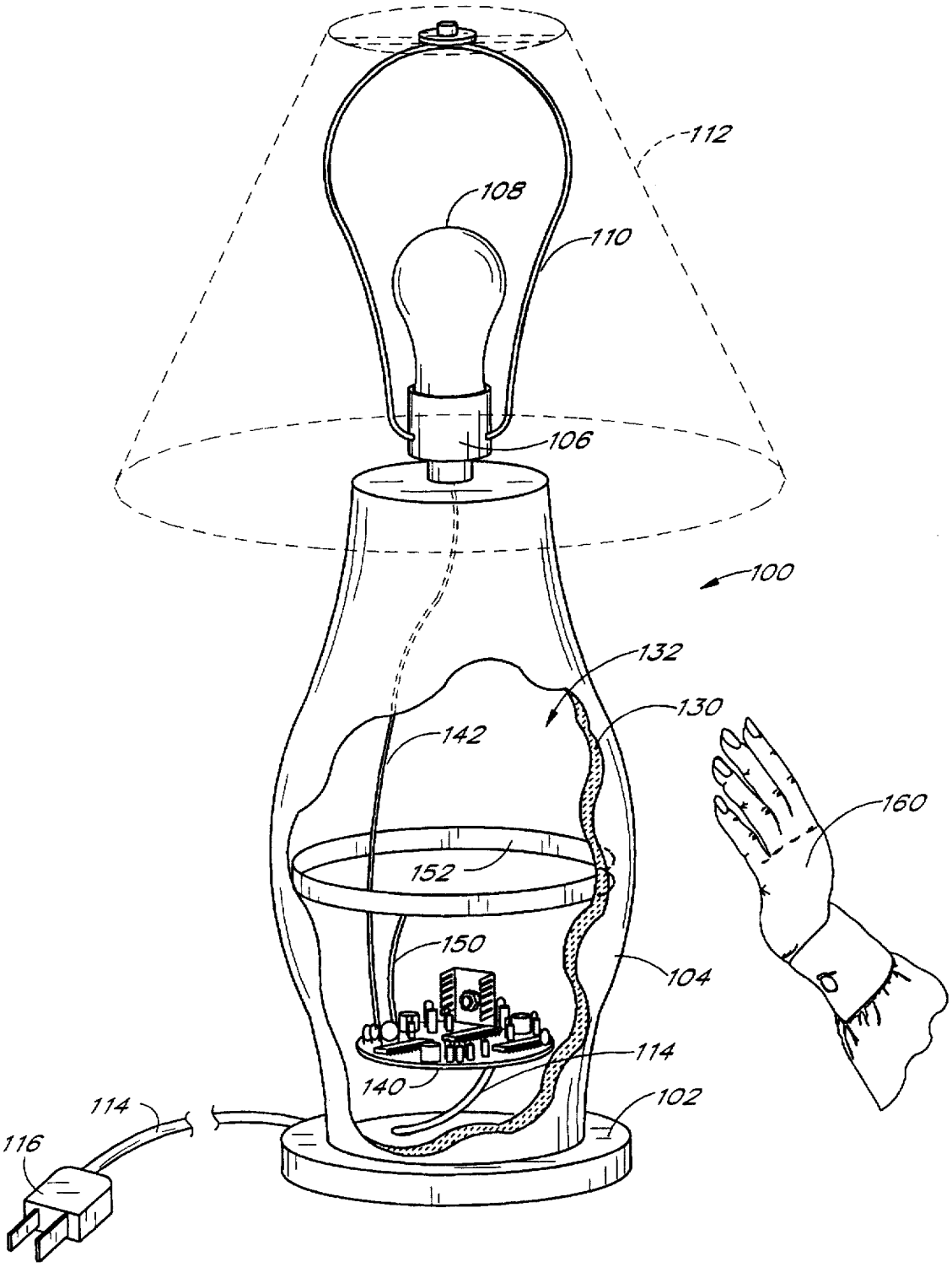
FIG. 1 illustrates a perspective view of an exemplary table lamp into which the present invention can be incorporated, the table lamp being partially cut away to show the circuit board and the sensing antenna mounted therein.

FIG. 1 illustrates a perspective view of an exemplary table lamp 100 into which the present invention can be incorporated. The table lamp 100 comprises a base 102; a main body portion 104; a conventional lamp socket 106 supported by the main body portion 104; a conventional incandescent bulb 108 mounted in the lamp socket 106; a harp 110 coupled to the socket 106; and a conventional lamp shade 112 (shown in phantom) supported by the harp 110. Electrical power is provided to the lamp 100 via a conventional power cord 114 having a conventional polarized plug 116 at one end thereof. When the lamp 100 is operated, the plug 116 is plugged into a conventional electrical outlet (not shown).

The exterior appearance of the lamp 100 in FIG. 1 is exemplary of many different styles of table lamps and is for illustrative purposes only. The main body portion 104 comprises a hollow outer shell 130 which can be constructed from plastic, Bakelite, ceramic, or any of a number of other electrically non-conductive materials. In preferred embodiments, the main body portion 104 comprises HYDROCAL, a water-based plaster similar to plaster of paris, which can be formed in a mold to a desired shape and covered with a finish to imitate ceramic, marble, or a number of other materials. As illustrated, the hollow outer shell 130 of the main body portion 104 forms a cavity 132.

A portion of the shell 130 is removed in FIG. 1 to show a printed circuit board 140 positioned within the cavity 132 proximate to the base 102. The printed circuit board 140 is advantageously supported by standoffs (not shown) from the base 102 or by other suitable supporting devices extending from the inside of the shell 130. The printed circuit board 140 is electrically connected to the power cord 114 to receive power when the plug 116 is plugged into an electrical outlet. The printed circuit board 140 provides controlled output power via a power cord 142 which connects the printed circuit board 140 to the lamp socket 106. The printed circuit board 140 has a sense input which is connected via a wire 150 to a sensing antenna 152. As illustrated, the sensing antenna 152 is mounted to the inside of the shell 130. In the preferred embodiment illustrated in FIG. 1, the sensing antenna 152 comprises a ring of copper or aluminum foil, and the sensing antenna 152 is mounted to the inside surface of the shell 130 using epoxy or other suitable adhesive. Alternatively, the sensing antenna 152 may be formed into the shell 130 by placing the sensing antenna 152 in the mold and pouring the liquid HYDROCAL or other material into the mold to surround the sensing antenna 152. It should be understood that a connecting wire will extend out of the shell 130 into the cavity 132 to provide an electrical connection to the sensing antenna 152. One skilled in the art will appreciate that the flexible sensing antenna 152 can be manipulated to fit the inside cavity of lamps having non-circular shapes, such as squares, triangles or the like.

One particular advantage to the present invention is that the sensing antenna can be added to an existing hollow lamp by positioning the printed circuit board 140 and the sensing antenna 152 within the cavity of the lamp as described above. Thus, the proximity switch can be added without changing the external appearance of the lamp, a particularly important consideration for antique lamps and other valuable lamps.

As illustrated in FIG. 1, and as described below, the present invention is controlled by moving a human hand 160, or the like, proximate to the body portion 104 of the lamp 100 in the vicinity of sensing antenna 152. Generally, the sensing antenna 152 will be positioned within the cavity 132 such that it will be proximate to a distinct landmark on the lamp, such as, for example, the location of the largest diameter of the body portion 104, as illustrated in FIG. 1, near the middle of the body portion 104, or the like. In any case, a user will quickly learn where the most sensitive area of the lamp is after using the lamp a few times. As the user's hand 160 approaches the body portion 104 of the lamp 100, the circuitry on the printed circuit board 140 will cause the power to the incandescent bulb 108 to be switched. If the power was originally off, the power will be switched on to cause the bulb 108 to illuminate. If the power was originally on, the power will be switched off to cause the bulb 108 to stop emitting light. The circuitry on the printed circuit board 140 will operate only once while the hand 160 remains in the vicinity of the lamp 100. Thus, the power will not be switched multiple times unless the hand 160 is moved away and then returned to the vicinity of the lamp 100.

Unlike touch control circuits of the prior art, the present invention operates as a proximity switch so that it is not necessary to touch the lamp 100 in order to activate the switch. Thus, the lamp 100 will not become marred with fingerprints, and the lamp will not be subject to damage by over-zealous users who may assume that a firm touch is better than a gentle touch.

Figure 2:
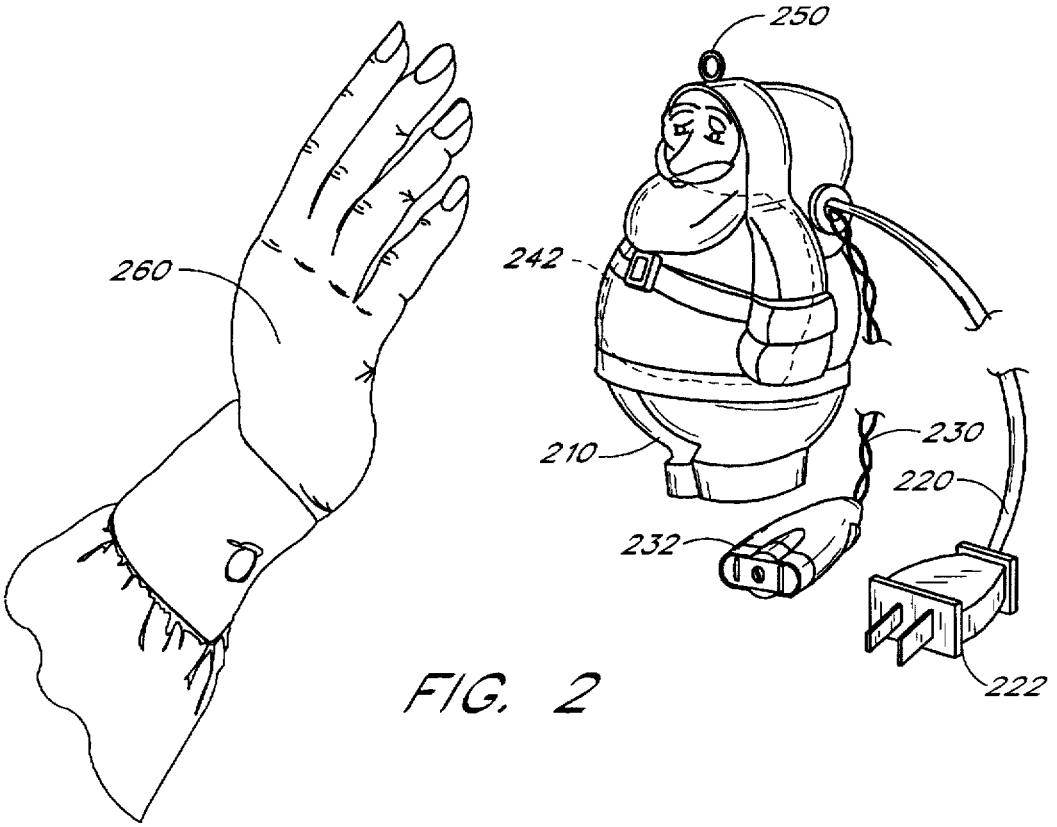
FIG. 2 illustrates a perspective view of a decorative ornament in accordance with the present invention.
Figure 3:
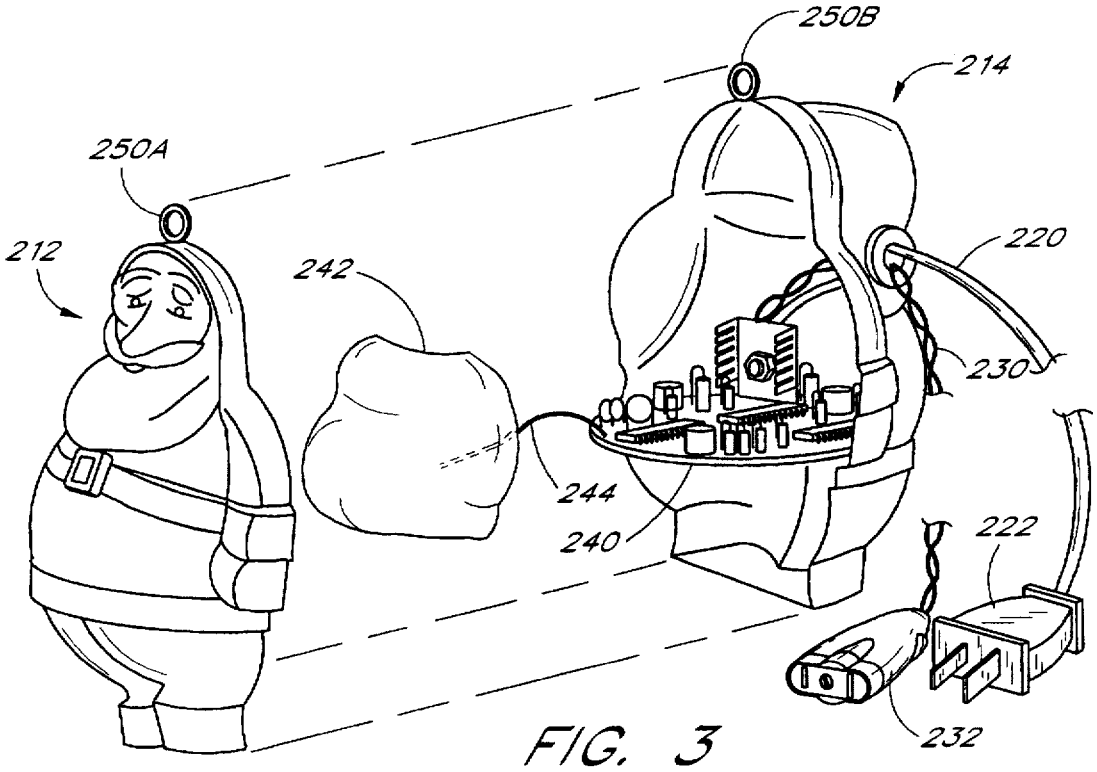
FIG. 3 illustrates an exploded perspective view of the decorative ornament of FIG. 2 showing the circuit board mounted therein and further showing the foil sensing antenna.

The present invention can also be incorporated into other devices for control of lighting other than lamps. For example, FIGS. 2 and 3 illustrate a perspective view of a decorative ornament 200 which controls electrical power in accordance with the present invention. The embodiment of FIG. 2 is particularly well-suited for use in controlling decorative holiday lights and is thus configured as a holiday ornament (e.g., Santa Claus). As illustrated in FIGS. 2 and 3, the ornament 200 comprises a hollow plastic body 210 having first and second portions (e.g., a front portion 212 and a rear portion 214). Preferably, the body 210 comprises a high impact plastic or other electrically non-conductive material. An input power cord 220 enters the rear portion 214 via an opening 216 which is advantageously fitted with a grommet 218 which protects the input power cord 220 from abrasion. The input power cord 220 includes a conventional power plug 222 which is plugged into an conventional electrical outlet (not shown) when the invention is in use. An output power cord 230 exits from the opening 216 through the grommet 218 and is terminated with a conventional power socket 232. A string of ornamental lights, or the like, is plugged into the power socket 232 when the invention is in use. It should be understood that in some embodiments of the ornament 200, the power socket 232 can be mounted directly on the body 210; however, in such an embodiment, the structure of the ornament 200 must have sufficient strength to withstand the forces of plugging and unplugging a string of lights into the power socket 232.

As illustrated in FIG. 3, a printed circuit board 240 is mounted in the body 210 and is constrained by the front portion 212 and the rear portion 214 when the body 210 is assembled. The input power cord 220 is connected as an input to the printed circuit board 240, and the output power cord 230 is connected as an output from the printed circuit board 240. A sensing antenna 242 is electrically connected to the printed circuit board 240 via a wire 244. For example, the sensing antenna 242 in FIG. 3 preferably comprises a sheet of copper or aluminum foil which is formed on the inside of the front portion 212 of the body 210. Thus, the sensing antenna 242 readily conforms to the shapes of various ornamental designs. Preferably, the sensing antenna 242 is affixed to the inside of the front portion 212 by epoxy or other suitable adhesive.

After mounting the printed circuit board 240 and the sensing antenna 242 in the body 210, and after completing the electrical connections, the front body portion 212 and rear body portion 214 are mutually attached (e.g., by a suitable adhesive such as epoxy) to enclose the electrical circuitry on the printed circuit board 240 within an insulated shell formed by the body 210 to prevent possible exposure to the AC electrical voltage controlled by the printed circuit board 240.

As illustrated, the body 210 preferably includes a ring 250 or other support device which permits the ornament 200 to be hung from the branches of a holiday tree or from another suitable location. In the preferred embodiment, a front ring portion 250A and a rear ring portion 250B of the ring 250 are mounted on the front body portion 212 and the rear body portion 214, respectively, for enhanced support for the ornament 200.

Alternatively, the ornament 200 can be formed as a freestanding ornament with a base or the like so that the ornament can be placed on a table top, a fireplace mantle, or the like.

In operation, the plug 222 is plugged into a conventional electrical outlet (either directly or via an extension cord, or the like). A string of ornamental lights (not shown), or other electrical device to be controlled, is plugged into the socket 232. The ornament 200 is suspended from a branch of holiday tree or other suitable location proximate to the lights or other controlled device. When a hand 260 is moved next to the ornament 200, the presence of the hand 260 is sensed and the power provided to the socket 232 and thus to the controlled lights or other device is controlled. If the power to the socket 232 is initially off, the power will be turned on. If the power to the socket 232 is initially on, the power will be turned off. When the hand 260 is moved away from the ornament 200 and again returned to the vicinity of the ornament 200, the power will again be switched from one state to the opposite state. The present invention does not require that the ornament 200 be touched. Thus, there is substantially less probability of dislodging the ornament 200 from the supporting branch, or the like, than if the ornament 200 had to be touched in order to operate.

Figure 4A:
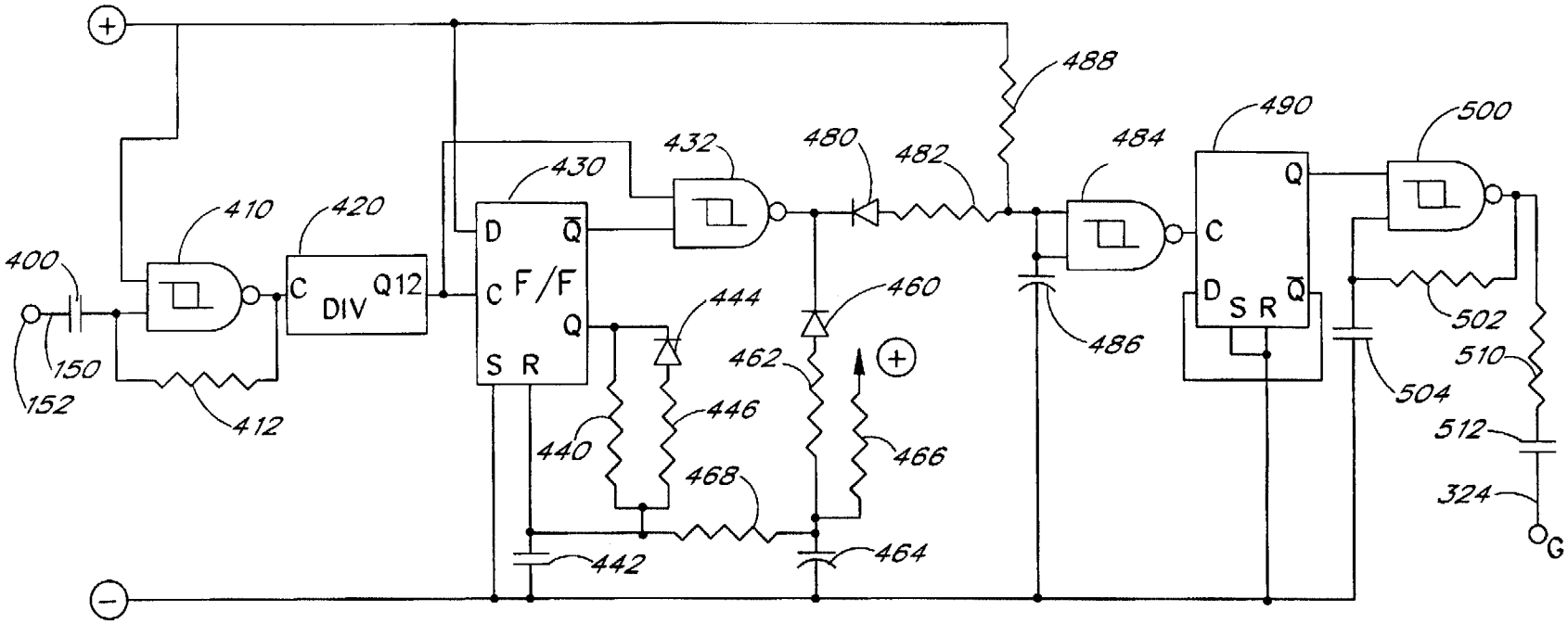
FIG. 4A illustrates a schematic diagram of an electronic circuit in accordance with the present invention.
Figure 4B:
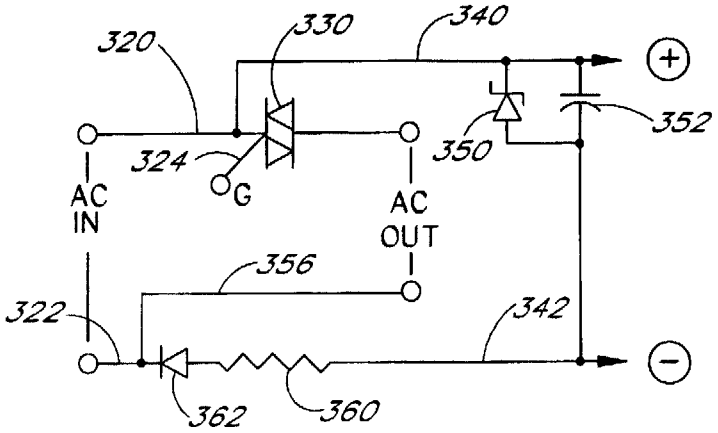
FIG. 4B illustrates a power supply which provides power for the electronic circuit of FIG. 4A.

FIG. 4A illustrates a schematic diagram of an electronic circuit 300 in accordance with the present invention; and FIG. 4B illustrates a power supply 310 which provides power for the electronic circuit of FIG. 4A. The electronic circuit 300 and the power supply 310 are mounted on the printed circuit board 140 of FIG. 1 or the printed circuit board 240 of FIG. 3. For convenience, the electronic circuit 300 will be described in connection with the printed circuit board 140 of FIG. 1; however, it should be understood that a similar description would apply in connection with the printed circuit board 240 of FIG. 3.

In FIG. 4B, power is received on first and second AC input lines 320 and 322 which are part of the power cord 114 in FIG. 1. A controlled AC output is provided on first and second AC output lines 324 and 326 which are part of the power cord 142 within the lamp 100 of FIG. 1. Preferably, the power plug 116 (FIG. 1) is polarized such that the second AC input line 322 is connected to AC neutral and the first AC input line 320 is connected to AC hot. The second AC output line 326 is connected directly to the second AC input line 322. The first AC output line 324 is connected to the first AC input line 320 via a triac 330 so that the hot side of the AC power is switched. The triac 330 has a gate input 332 which is controlled by a gate signal G on a gate signal line 334. In the preferred embodiment described herein, the triac 330 is advantageously an L4006L6 triac commercially available from TECCOR.

The power supply circuit 310 provides a positive DC voltage between a first DC supply line (+) 340 and a second DC supply line (−) 342. A simple DC power supply comprises a Zener diode 350 having its cathode connected to the first DC supply line 340 and having its anode connected to the second DC supply line 342. The first DC supply line 340 is connected directly to the first AC input line 320. A filter capacitor 352 is connected across the Zener diode 350.

The second DC supply line 342 is connected to the second AC input line 322 via a resistor 360 in series with a diode 362. A first terminal of the resistor 360 is connected to the second DC supply line 342, and a second terminal of the resistor 360 is connected to the anode of the diode 362. The cathode of the diode 362 is connected to the second AC input line 322.

The diode 362 and the resistor 360 function as a half-wave rectifier such that a positive DC voltage is developed across the Zener diode 350 and the filter capacitor 352. It should be understood that the first DC supply line 340 follows the AC voltage on the first AC input line 320 and that the second DC supply line 342 is negative with reference to the first AC input line 320. There is no absolute ground reference in the circuit of FIGS. 4A and 4B; however, it should be understood that the negative DC voltage supply (−) can be considered as a logic ground for the integrated circuits described below.

Preferably, the Zener diode 350 is a 1N5246B Zener diode having a nominal Zener voltage of 16 volts such that the Zener diode 350 limits the maximum voltage between the first and second DC supply lines 340, 342 to 16 volts. The filter capacitor 332 is preferably a 47 microfarad electrolytic capacitor. The resistor 360 has a resistance of approximately 8,200 ohms. The diode 362 is preferably a 1N4004 general purpose rectifier diode.

The power supply lines 340, 342 provide DC power to the circuit 300 of FIG. 4A which comprises three CMOS integrated circuits and a plurality of discrete components described below. The positive DC line 340 is connected to the VDD supply terminals of each integrated circuit and the negative DC line 342 is connected to the VSS supply terminal of each integrated circuit. For simplicity, the connections to the VDD and VSS supply terminals of the integrated circuits are not shown. It should be understood that the logic signals described below are referenced to the VSS supply terminal of each integrated circuit and are thus referenced to the negative voltage supply.

Starting at the left side of FIG. 4A, it can be seen that the sensing antenna 152 is coupled to a first terminal of an input capacitor 400 via the line 150. A second terminal of the input capacitor 400 is connected to a first input of a first two-input NAND gate 410 having Schmitt trigger action on its inputs. The NAND gate 410 is one gate of a CD4093BE CMOS integrated circuit comprising four identical Schmitt trigger NAND gates. The CD4093BE integrated circuit and the other integrated circuits described below are available from Harris Corporation and from a number of other sources.) A second input of the first NAND gate 410 is connected to the positive voltage supply such that the input has a constant logic "1" applied to it. Thus, the first NAND gate 410 is connected to function as an inverter.

The output of the first NAND gate 410 is connected to one terminal of a resistor 412. A second terminal of the resistor 412 is connected to the first input of the first NAND gate 410. When connected as shown, the first NAND gate 410 operates as an oscillator with the frequency of oscillation determined by the resistance of the resistor 410, the capacitance of the input capacitor 400, and additional capacitance coupled to the circuit via the sensing antenna 152. In the preferred embodiment, the resistor 412 has a nominal resistance of approximately 390,000 ohms and the capacitor 400 has a nominal capacitance of approximately 470 picofarads. The resistance of the resistor 412 can be selected in accordance with the configuration of the sensing antenna 152 to provide a nominal frequency of oscillation of approximately 500,000 Hz. As discussed below, the oscillation frequency will vary when the hand 160 (FIG. 1) is moved into the vicinity of the sensing antenna 152.

The output of the first NAND gate 410 is also connected to a clock input of a 12-stage divider circuit (DIV) 420, such as, for example, a CD4040BE available from Harris Corporation. A Q12 output of the divider circuit 420 provides a signal output which is 1/4096 of the frequency of the signal applied to the clock input. For example, when a 500,000 Hz signal is applied to the clock input, the Q12 output has a frequency of approximately 122 Hz. When the frequency of the signal output of the first NAND gate 410 varies in response to the proximity of the hand 160, the frequency of the Q12 output of the divider circuit 420 will vary proportionately.

The output of the divider circuit 420 is connected to the clock input (C) of a first bistable flip-flop 430, which is advantageously one flip-flop in a CD4013BE integrated circuit available from Harris Corporation having two such flip-flops in a single integrated circuit. The first flip-flop 430 has a data input (D) which is connected to the positive voltage supply to provide a constant logic "1" input. The first flip-flop 430 has a set input (S) which is connected to the negative voltage supply to provide a constant logic "0" input so that the set input is always inactive.

The first flip-flop 430 has a Q output and a complementary $\overline{Q}$ output. The $\overline{Q}$ output of the first flip-flop 430 is connected to a first input of a second two-input NAND gate 432. A second input of the second two-input NAND gate 432 is connected to the Q12 output of the divider circuit 420. The Q output of the first flip-flop 430 is connected to a first terminal of a resistor 440. A second terminal of the resistor 440 is connected to a reset input (R) of the first flip-flop 430. The reset input of the first flip-flop 430 is also connected to a first terminal of a capacitor 442. A second terminal of the capacitor 442 is connected to the negative voltage supply. A diode 444 has its cathode connected to the Q output of the first flip-flop 430 and has its anode connected to a first terminal of a resistor 446. A second terminal of the resistor 446 is connected to the reset input of the first flip-flop 430. Thus, the diode 444 and the resistor 446 are connected in series across the resistor 440. In the preferred embodiment, the diode 444 is a 1N4148 diode, the resistor 440 has a resistance of approximately 200,000 ohms, the resistor 446 has a resistance of approximately 15,000 ohms, and the capacitor 442 has a capacitance of approximately 0.047 microfarad. When connected as just described, the first flip-flop 430 operates as a one-shot multivibrator. That is, on each low-to-high transition of the clock input of the first flip-flop 430 (i.e., the Q12 output of the divider circuit 420), the logic "1" level on the data input (D) will be transferred to the Q output to force the Q output to a high, logic "1," level. The capacitor 442 will begin charging via the resistor 440. (The diode 444 blocks any charging current through the resistor 446.) When the voltage across the capacitor 442 reaches the input threshold voltage of the reset input (R) of the first flip-flop 430, the first flip-flop 430 is reset to cause the Q output to be forced low and to cause the $\overline{Q}$ output to be forced high. When this occurs, the capacitor 442 is rapidly discharged via the diode 444 and the resistor 446 to prepare the capacitor 442 to be charged on the next clock cycle.

The Q12 output of the divider circuit 420 has a duty cycle of 50 percent such that the signal is a logic "1" for the first half of each clock cycle and a logic "0" for the second half of each clock cycle. If the $\overline{Q}$ output is reset to its high level during the first half of each clock cycle, both inputs to the second NAND gate 432 will be at a logic "1" level to satisfy the NAND condition and to cause the output of the second NAND gate 432 to transition to a low (logic "0") level until the end of the first half of the clock cycle. This occurs when the duration of the first half-cycle of the Q12 output signal is greater than the duration of the logic "1" Q output pulses from the first flip-flop 430. On the other hand, when the duration of the first half-cycle of the Q12 output signal is less than the duration of the logic "1" Q output pulses from the first flip-flop 430, the $\overline{Q}$ output signal will not be reset to a logic "1" until after the Q12 output signal has returned to a logic "0." Thus, the NAND condition is not satisfied, and the output of the second NAND gate 432 will remain high. It can thus be seen that the first flip-flop 430 and the second NAND gate 432 operate as a frequency detector such that when the oscillator (comprising the first NAND gate 410, the resistor 412, the capacitor 400 and the sensing antenna 152) operates at a relatively high frequency, no output pulses are generated from the output of the second NAND gate 432. On the other hand, when the hand 160 (FIG. 1) is near the sensing antenna 152, the oscillator frequency lowers and logic "0" pulses appear on the output of the second NAND gate 432.

The foregoing describes the basic operation of the detection of the presence of the hand 160 proximate to the sensing antenna 152; however, differing conditions proximate to the sensing antenna 152 may cause the ambient capacitance to be sufficient to cause pulses to be detected when the hand 160 is not proximate to the sensing antenna 152. Alternatively, the conditions may be such that the hand 160 is not detected consistently when the hand 160 is proximate to the sensing antenna 152. Thus, the preferred embodiment of the circuit 300 includes a feedback circuit which operates in a manner similar to an automatic gain control to null out ambient capacitance. In particular, a diode 460 has its cathode connected to the output of the second NAND gate 432. The anode of the diode 460 is connected to a first terminal of a resistor 462. A second terminal of the resistor 462 is connected to a first terminal of a capacitor 464. A second terminal of the capacitor 464 is connected to the negative voltage supply. A resistor 466 is connected between the first terminal of the capacitor 464 and the positive voltage supply. A resistor 468 is connected between the first terminal of the capacitor 464 and the first terminal of the capacitor 442. The diode 460 is preferably a 1N4148 diode.

The resistor 462 preferably has a resistance of approximately 2,200 ohms. The capacitor 464 preferably has a capacitance of approximately 47 microfarad. The resistor 466 preferably has a resistance of approximately 100,000 ohms. The resistor 468 preferably has a resistance of approximately 220,000 ohms.

The feedback circuit comprising the diode 460, the resistors 462, 466, 468 and the capacitor 464 operates to bias the voltage across the capacitor 442 such that the duration of each pulse generated by the Q output of the first flip-flop 430 is maintained approximately equal to the duration of the first half-cycle of the Q12 output signal from the divider circuit 420. In particular, the capacitor 464 will charge via the resistor 466 connected to the positive voltage supply. The voltage across the capacitor 464 provides additional positive bias to the capacitor 442 via the resistor 468. Thus, a greater positive voltage across the capacitor 464 will cause the capacitor 442 to charge to the reset level (i.e., the threshold of the reset input of the first flip-flop 430) sooner. A smaller voltage across the capacitor 464 will cause the capacitor 442 to charge to the reset level later. Because of the interposition of the relatively large resistor 468, the capacitor 464 will not be discharged significantly when the Q output of the first flip-flop 430 is low. Thus, the capacitor 464 will continue to charge until discharged via the diode 460 and the resistor 462 when the output of the second NAND gate 432 has a logic low level. This will occur only when the duration of the logic "1" signal level on the Q output of the first flip-flop 430 is less than the duration of the first half-cycle of the Q12 output signal from the divider circuit 420. The amount by which the capacitor 464 is discharged when this occurs depends upon the duration of the logic "0" pulses generated by the second NAND gate 432 and thus depends upon the difference between the duration of the logic "1" level of the Q output signal and the duration of the first half-cycle of the Q12 output signal from the divider circuit 420. It can be seen that the feedback circuit will reach an equilibrium condition for each duration of the first half-cycle of the Q12 output signal as the oscillation frequency changes. When the oscillation frequency decreases, the logic "0" output pulses from the second NAND gate 432 will temporarily have a greater duration. This causes the capacitor 464 to discharge to a lower voltage which in turn causes the capacitor 442 to charge at a slower rate. This increases the duration of the Q output pulses from the first flip-flop 430 such that the duration of the logic "0" output pulses from the second NAND gate are reduced.

On the other hand, when the oscillation frequency increases such that the duration of the first half-cycle of the Q12 output signal from the divider circuit 420 is reduced, the logic "0" output pulses from the second NAND gate 432 have a shorter duration and may disappear altogether. This causes the capacitor 464 to charge to a greater voltage, which, in turn, causes the capacitor 442 to charge at a faster rate until the duration of the Q output pulses from the first flip-flop 430 decrease to a duration approximately equal to the duration of the first half-cycle of the Q12 output signal at which time the logic "0" output pulses from the second NAND gate 432 reappear to again reduce the voltage on the capacitor 464.

The feedback circuit has a relatively long time constant such that the electronic circuit 300 will respond readily to the rapid, large change in capacitance caused by bringing a hand proximate to the sensing antenna, but the feedback circuit will tend to null out slow changes in capacitance caused by ambient conditions (e.g., large objects in the vicinity of the sensing antenna).

The output of the second NAND gate 432 is also connected to the cathode of a diode 480. The anode of the diode 480 is connected to a first terminal of a resistor 482. A second terminal of the resistor 482 is connected to first and second inputs of a third NAND gate 484, which is thus connected as an inverter. The second terminal of the resistor 482 is also connected to a first terminal of a capacitor 486. A second terminal of the capacitor 486 is connected to the negative voltage supply. The second terminal of the resistor 482 is also connected to a first terminal of a resistor 488. A second terminal of the resistor 488 is connected to the positive voltage supply. The third NAND gate 484 has an output which is connected to a clock input (C) of a second flip-flop 490, which is advantageously part of the same integrated circuit as the first flip-flop 430, and which operates in a similar manner. The set (S) and reset (R) inputs of the second flip-flop 490 are connected to the negative voltage supply and are thus continuously inactive. The $\overline{Q}$ output of the second flip-flop 490 is connected to its data input (D) such that each low-to-high transition of the clock input (C) causes the second flip-flop 490 to toggle. That is, if the Q output of the second flip-flop 490 is high (logic "1") such that the $\overline{Q}$ output is low (logic "0"), the Q output will switch to a low (logic "0") level; and, if the Q output is low such that the $\overline{Q}$ output is high, the Q output will switch to a high logic level.

The diode 480 is preferably a 1N4148 diode. The resistor 482 preferably has a resistance of approximately 510 ohms and the resistor 488 preferably has a resistance of approximately 22,000 ohms. The capacitor 486 preferably has a capacitance of approximately 10 microfarad. The diode 480, the resistors 482, 488 and the capacitor 486 operate as an integrator. The capacitor 486 is normally charged via the resistor 488 to a relatively high voltage value such that a logic "1" is applied to the inputs of the third NAND gate 484. The capacitor 486 is discharged via the diode 480 and the resistor 482 each time the second NAND gate 432 generates a logic "0" output pulse. As long as the logic "0" output pulses from the second NAND gate 432 have a relatively short duration, the capacitor 486 will be discharged by a relatively small amount and will remain charged to a sufficient voltage that the inputs to the third NAND gate 484 remain at a logic "1" level. Slow changes in the oscillation frequency will result in minor temporary changes to the durations of the logic "0" output pulses which are thus integrated out by the capacitor 486. However, when the hand 160 is moved into proximity to the sensing antenna 152, the oscillation frequency rapidly decreases to cause the duration of the first half-cycle of the Q12 output signal from the divider 420 to increase significantly. This results in a substantial increase in the duration of the logic "0" output pulses from the second NAND gate 432. The durations of the logic "0" output pulses are sufficient to discharge the capacitor 486 to a voltage level below the threshold of the inputs to the third NAND gate 484 such that a logic "0" input is applied to the inputs of the third NAND gate 484. This results in a transition of the output of the third NAND gate 484 from a logic "0" to a logic "1." The transition to the logic "1" level clocks the second flip-flop 490 and causes it to toggle from its previous state to the opposite state. In particular, if the Q output of the second flip-flop 490 was a logic "0," it will toggle to a logic "1," and vice versa. Thus, the second flip-flop 490 will toggle each time the hand 160 is moved proximate to the sensing antenna 152.

As long as the hand 160 is maintained proximate to the sensing antenna 152, the second flip-flop 490 will not toggle again. In particular, although the feedback circuit may try to reduce the duration of the logic "0" output pulses from the second NAND gate 432, the feedback circuit in preferred embodiments does not have a sufficient range to compensate for the lower oscillation frequency caused by the presence of the hand 160 proximate to the sensing antenna 152. Thus, the capacitor 486 continues to be discharged to maintain the inputs of the third NAND gate 484 at a logic "0" level. Even if the feedback circuit were to compensate for the presence of the hand 160, it is unlikely that the capacitance on the sensing antenna 152 could be increased further to cause the second flip-flop 490 to be triggered again.

When the hand 160 is moved away from the sensing antenna 152, the oscillation frequency will increase and the logic "0" output pulses from the second NAND gate 432 will temporarily cease until the feedback circuit adjusts the voltage across the capacitor 464. Thus, the capacitor 486 will again charge to change the inputs of the third NAND gate 484 to a logic "1." Thus, the output of the third NAND gate 484 will change to a logic "0" until the hand 160 is again brought into the vicinity of the sensing antenna 152, at which time the output of the third NAND gate 484 will again change to a logic "1" to again toggle the second flip-flop 490.

The Q output of the second toggle flip-flop is connected to a first input of a fourth NAND gate 500. The fourth NAND gate 500 has an output which is connected to a first terminal of a resistor 502. A second terminal of the resistor 502 is connected to a second input of the fourth NAND gate 500. The second terminal of the resistor 502 is also connected to a first terminal of a capacitor 504. A second terminal of the capacitor 504 is connected to the negative voltage supply. In the preferred embodiment, the resistor 502 has a resistance of approximately 470,000 ohms and the capacitor 504 has a capacitance of approximately 0.001 microfarad.

When the Q output of the second flip-flop 490 is at a logic "0" level, the output of the fourth NAND gate 500 is forced inactive high. When the Q output of the second flip-flop 490 is at a logic "1" level, the output of the fourth NAND gate 500 will oscillate because of the feedback provided by the resistor 502. In particular, when the output of the fourth NAND gate 500 is high, the capacitor 504 will charge via the resistor 502 until the voltage across the capacitor 504 reaches the logic "1" input threshold of the second input of the fourth NAND gate 500, at which time both inputs of the fourth NAND gate 500 will be a logic "1." When both inputs of the NAND gate 500 are at a logic "1" level, the output of the fourth NAND gate 500 will switch to a logic "0" level, and the capacitor 504 will begin to discharge. The capacitor 504 will discharge until the voltage across the capacitor 504 reaches the logic "0" input threshold of the second input of the fourth NAND gate 500, at which time the output of the fourth NAND gate 500 will switch to a logic "1" level. This oscillation will continue as long as the Q output of the second flip-flop 490 is at a logic "1" level. The resistance of the resistor 502 and the capacitance of the capacitor 504 are selected to produce a 4,000–5,000 Hz oscillation frequency.

The output of the fourth NAND gate 500 is connected to a first terminal of a resistor 510. A second terminal of the resistor 510 is connected to a first terminal of a capacitor 512. A second terminal of the capacitor 512 is connected via the signal line 324 to the gate G of the triac 330. The resistor 510 preferably has a resistance of approximately 510 ohms, and the capacitor 512 preferably has a capacitance of approximately 0.0033 microfarad. The resistor 510 and the capacitor 512 provide AC coupling from the output of the fourth NAND gate 500 to the gate G of the triac 330. Basically, each time the output of the fourth NAND gate 500 switches between logic levels, the transition is coupled through the capacitor 512 to the gate G of the triac 330 to trigger the triac 330 to conduct current from the first AC input line to the first AC output line 324. Once triggered, the triac 330 will continue to conduct current until the end of the current AC half cycle, at which time it must be retriggered to conduct current in the opposite direction. Although it is not necessary to retrigger the triac 330 multiple times in a half cycle, there is no harm in doing so. By triggering the triac 330 at a rate of 4,000–5,000 times per second, the triac 330 is triggered 33–42 times per half cycle of conventional 60 Hz power, thus assuring that the triac 330 is triggered early in each half cycle (e.g., within 6 degrees of the zero-crossing of each half cycle). This occurs without requiring a zero-crossing detector, or the like.

It can thus be seen that when the Q output of the second flip-flop 490 is at a logic "1" level, the triac 330 will be turned on to provide current flow to the incandescent bulb 108 (FIG. 1). When the Q output of the second flip-flop is at a logic "0" level, the triac 330 will not be turned on and no current will be provided to the incandescent bulb 108. Thus, by controlling the second flip-flop 490 in response to the proximity of the hand 160 (FIG. 1), the incandescent bulb 108 is thereby controlled without touching the lamp 100. It should be understood that although the present invention is described with respect to an incandescent bulb 108 or string of decorative lights, other electrical devices can also be controlled. For example, a socket-mounted fluorescent lighting fixture (not shown) can be substituted for the incandescent bulb 108.

In alternative embodiments of the present invention, the on/off power control can be replaced with a multi-level power control system such as described, for example, in U.S. Pat. No. 4,119,864 to Petrizio, which is incorporated by reference herein. Rather than toggling the power on and off each time the hand 160 (FIG. 1) is brought into the vicinity of the sensing antenna 152, a counter within the power control system is incremented to vary the power applied to an incandescent lamp, or the like. Such an embodiment includes a zero-crossing detector and a phase angle control system, such as described in U.S. Pat. No. 4,119,864.

While preferred embodiments of this invention have been disclosed herein, those skilled in the art will appreciate that changes and modifications may be made therein without departing from the spirit and scope of the invention as defined in the appended claims.

What is claimed is:

1. A control device for ornamental lights, said control device comprising:

a hollow ornament having a shell comprising an electrically insulating material, said shell of said hollow ornament having at least one opening;

a power input cord positioned through said opening, said power input cord having a first end outside said shell and connectable to a source of power, said power cord having a second end within said shell;

a power output positioned through said opening, said power output having a first end within said shell, said power output having a second end outside said shell and connectable to provide power to said ornamental lights;

a sensing antenna positioned within said shell and electrically insulated by said shell; and a power control circuit having a power input electrically connected to said second end of said power cord, said power control circuit having a power output electrically connected to said first end of said power output, said power control circuit electrically connected to said sensing antenna and responsive to changes in capacitance sensed by said sensing antenna to control power applied to said power output.

2. The control device for ornamental lights as defined in claim 1, wherein said power control circuit comprises:

a variable frequency oscillator responsive to changes in capacitance sensed by said antenna to vary an oscillation frequency of said oscillator; and a detection circuit coupled to receive a signal responsive to said oscillation frequency of said oscillator, said detection circuit generating a detection output signal, said detection circuit activating said detection output signal when said oscillation frequency decreases, said power control circuit responsive to said detection output signal to vary the power applied to said power output.

3. The control device for ornamental lights as defined in claim 2, wherein said detection circuit comprises a one-shot multivibrator which generates a measuring pulse for each cycle of said signal responsive to said oscillation frequency, said detection circuit generating said detection output signal in response to a detected difference between a duration of said measuring pulse and a duration of a half-cycle of said signal responsive to said oscillation frequency.

4. The control device for ornamental lights as defined in claim 3, wherein said duration of said measuring pulse varies in response to relatively slow changes in said oscillation frequency of said variable frequency oscillator so that said detection circuit remains sensitive to rapid changes in said oscillation frequency.

* * * * *